United States Patent [19]

Hidaka et al.

[11] 4,448,159

[45] May 15, 1984

[54] V-TYPE INTERNAL COMBUSTION ENGINE

[75] Inventors: Yoshiaki Hidaka; Tadashi Tsuchiyama, both of Saitama, Japan

[73] Assignee: Honda Giken Kogyo Kabushiki Kaisha, Tokyo, Japan

[21] Appl. No.: 346,280

[22] Filed: Feb. 5, 1982

[30] Foreign Application Priority Data

Feb. 16, 1981 [JP] Japan ..... 56-21144
Feb. 16, 1981 [JP] Japan ..... 56-21145

[51] Int. Cl.[3] ..... F01P 3/02

[52] U.S. Cl. ..... 123/195 C; 123/195 R; 123/198 C; 123/55 VF; 123/55 VS; 123/55 VE; 123/90.31; 123/41.44

[58] Field of Search ..... 123/195 R, 195 C, 198 C, 123/55 VS, 55 VE, 55 VF, 90.31, 41.44

[56] References Cited

U.S. PATENT DOCUMENTS

| | | | |
|---|---|---|---|
| 2,713,332 | 7/1955 | Beardsley | 123/41.44 |
| 3,418,994 | 12/1968 | Freyn | 123/195 R |
| 3,438,360 | 4/1969 | Turner | 123/90.31 |
| 3,863,617 | 2/1975 | Thien et al. | 123/195 C |

*Primary Examiner*—Craig R. Feinberg
*Assistant Examiner*—David A. Okonsky
*Attorney, Agent, or Firm*—Lyon & Lyon

[57] ABSTRACT

A V-type internal combustion engine has a timing gear mechanism positioned in front of the cylinder block for driving the camshaft from the crankshaft. A coolant pump is secured to the cylinder block laterally offset from the crankshaft and adjacent one bank of cylinders. A first discharge passage leads from the coolant pump to the adjacent bank of cylinders and the second discharge passage is formed on a cover for the timing gear mechanism for supplying coolant to the remote bank of cylinders.

2 Claims, 2 Drawing Figures

V-TYPE INTERNAL COMBUSTION ENGINE

This invention relates to internal combustion engines of the type having two banks of cylinders arranged in a V-shape.

In the conventional V-type engine a coolant pump operated by the crankshaft is positioned in front of and between the banks of cylinders, and an outlet port of the coolant pump is connected with an inlet port on each of the cylinder blocks through respective pipes. Accordingly, the axial length of the engine assembly including the coolant pump is larger than the length of the engine itself. This increases the space occupied by the engine, and this is particularly objectionable in the vehicle in which the engine extends in a direction at right angles to the longitudinal axis of the vehicle. When the coolant pump is provided in the V-shaped space between the two banks of cylinders, camshafts are mounted in the cylinder heads, resulting in an increase in height, and hence in overall dimensions of the engine. To achieve a balanced installation of the V-type engine on the vehicle body, it is preferable to support the engine at its opposite ends, but installation of the coolant pump between the cylinder banks prevents optimum engine balancing.

It is an object of the present invention to provide a compact and small sized V-type internal combustion engine which can be installed in a well balanced manner by locating the coolant pump on the front wall of one of the two banks of cylinders. The timing gear mechanism is provided in a central position between the two banks of cylinders and in front thereof. The offset coolant pump is driven from the crankshaft.

In another aspect of the invention, the coolant pump is connected by a first passage to the near bank of cylinders and is connected to the remote bank of cylinders by means of a second discharge passage by means of a pipe formed integrally with the cover for the timing gear mechanism.

Other and more detailed objects and advantages will appear hereinafter.

Figure 1:
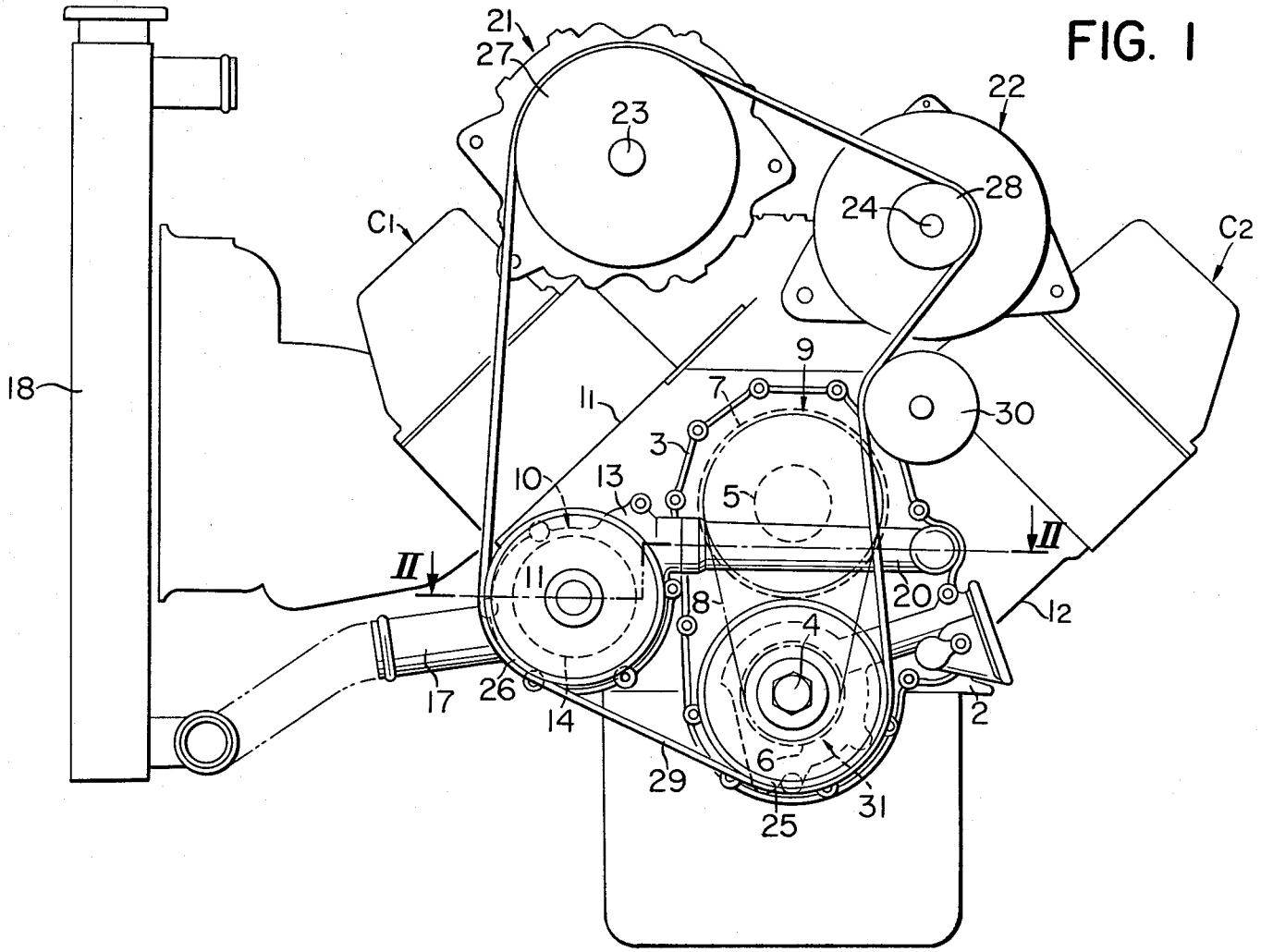
FIG. 1 is a front elevation showing a V-type internal combustion engine embodying a preferred form of this invention.

Referring to the drawings, reference symbols $C_1$, $C_2$ denote left and right banks of cylinders, which are arranged with a cross section in the shape of the letter "V" to form a V-type multi-cylinder internal combustion engine. A crank case 2 serves both left and right portions $\mathbf{1}_1$, $\mathbf{1}_2$, of the cylinder block for the two banks of cylinders. A front cover 3 is provided so as to bridge the front wall of the crank case 2 and the cylinder block portions $\mathbf{1}_1$, $\mathbf{1}_2$, and an end portion of the crankshaft 4 projects forward from the cover 3. The crankshaft 4 and the camshaft 5 are supported by the cylinder block 1 in close relationship, the camshaft being positioned between the two banks of cylinders $C_1$, $C_2$. A pair of timing gears 6 and 7 connected by a timing chain 8 comprise timing gear mechanism 9 enclosed within the cover 3. The camshaft 5 is driven at a reduction ratio of $\frac{1}{2}$.

Figure 2:
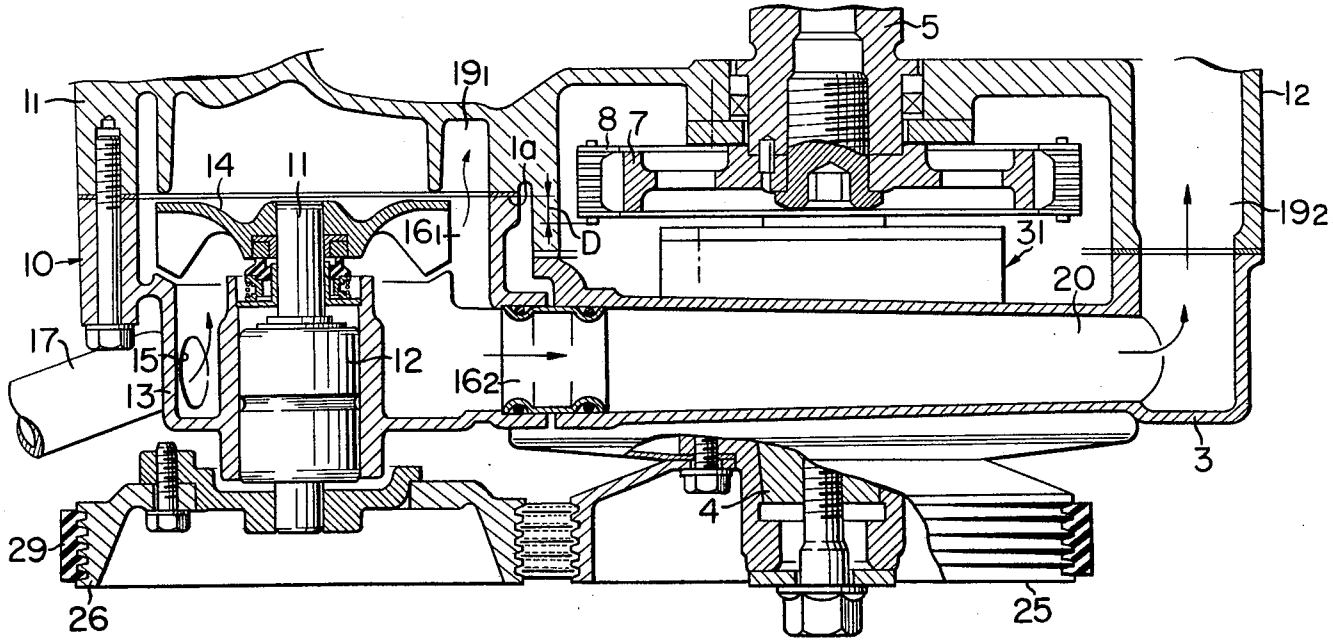
FIG. 2 is a sectional plan view taken substantially on the lines II—II as shown on FIG. 1.

A coolant circulating pump 10 is laterally offset from the crankshaft 4 in front of the left bank of cylinders $C_1$, the driving shaft 11 of the coolant pump 10 being parallel to the camshaft 5. The pump-mounting surface 1*a* of the left portion of the cylinder block is provided in a position to the rear of the front surface of the timing gear mechanism by the distance D (FIG. 2) so that the length of the engine in the axial direction of the crankshaft can be reduced. The driving shaft 11 of the coolant pump 10 is mounted to turn on a casing 13 by means of a bearing 12, and an impeller 14 is fixed on the inner end of the shaft 11. The pump casing 13 is provided with an inlet port 15 and two outlet ports $\mathbf{16}_1$, $\mathbf{16}_2$. The inlet port 15 communicates with a radiator 18 via a pipe 17. The first outlet port $\mathbf{16}_1$ communicates directly with a first opening $\mathbf{19}_1$ formed in the wall of the left portion of the cylinder block, and the second outlet port $\mathbf{16}_2$ communicates with a second opening $\mathbf{19}_2$ in the wall of the right portion $\mathbf{1}_2$ of the cylinder block via a pipe 20 formed integrally with the cover 3. An air compressor 21 having a driving shaft 23 is positioned above the coolant pump 10, and an AC generator 22 has its driving shaft 24 positioned on the right side of the air compressor 21.

The coolant pump-mounting surface 1*a* of the left portion $\mathbf{1}_1$ of the cylinder block is formed in a position to the rear from the corresponding position in the conventional V-type internal combustion engine by the distance D. Pulleys 25, 26, 27 and 28 are fixed respectively to the crankshaft 4, the coolant pump shaft 11, the air compressor shaft 23 and the AC generator shaft 24 in such a manner as to lie in the same plane. An endless transmission belt 29 is trained around the pulleys 25, 26, 27 and 28 for simultaneously driving the shafts 11, 23 and 24 from the crankshaft pulley 25. This makes it unnecessary to provide an independent belt transmission between the crankshaft 4 and the coolant pump 10 so that the overall length of the engine assembly can be reduced by the axial length of such conventional belt transmission. A pulley 30 maintains proper tension in the belt 29.

A lubricating oil supply pump 31 is driven by the crankshaft 4.

When the crankshaft 4 rotates, the coolant pump 10, air compressor 21, and AC generator 22 are operated by the transmission belt 29. The impeller 14 of the coolant pump 10 rotates with the driving shaft 11. A part of the coolant drawn from the radiator 18 into the coolant pump 10 is supplied from the first outlet $\mathbf{16}_1$ into a coolant passage (not shown), which is formed in the left portion $\mathbf{1}_1$ of the cylinder block to the first opening $\mathbf{19}_1$ to cool the same side $\mathbf{1}_1$ of the cylinder block. The remaining part of the coolant is supplied from the second outlet port $\mathbf{16}_2$ into the coolant passage (not shown), which is formed in the right portion $\mathbf{1}_2$ of the cylinder block, through the pipe 20 and second opening $\mathbf{19}_2$ to cool the portion $\mathbf{1}_2$ of the cylinder block.

Accordingly, a coolant pump-mounting surface on the cylinder block can be formed in a position to the rear of the front surface of the timing gear mechanism 9, so that the length of the engine in the axial direction of the crankshaft 4 can be reduced in accordance with the distance at which the coolant pump-mounting surface is spaced to the rear from the outer end surface of the timing gear mechanism 9. In addition, the length of the projecting portion of the coolant pump driving shaft 11 is set in accordance with the rearward displacement of the coolant pump-mounting surface to a length substantially equal to the projecting lengths of, for example, driving shafts for the air compressor 21 and the AC generator 22. This allows the three driving shafts to be rotated by the crankshaft 4 via the common transmission belt 29.

Therefore, unlike a conventional V-type engine provided with an independent belt drive for a coolant pump, the engine according to the present invention is reduced in overall length by an amount corresponding to the axial length of such conventional independent transmission belt. Even when the camshaft is provided in the closest possible position with respect to the crankshaft, the timing transmission gear connecting the camshaft and the crankshaft together does not interfere with the coolant pump, so that the height of the engine can be reduced. Therefore, owing to the three dimension reducing effects of the present invention, a small and compact engine can be obtained. Since the coolant pump is not provided in a position between the two banks of cylinders, the engine can be mounted at the central portion of the two cylinder banks, via brackets on a vehicle chassis, in a well-balanced state. This is advantageous, especially, in a vehicle in which the crankshaft extends at right angles to the longitudinal axis of the vehicle.

Furthermore, the front cover 3 enclosing the timing gear mechanism 9 for the engine is provided so as to bridge the left and right portions of the cylinder block for the two banks of cylinders. The coolant pump with its pair of outlet ports is secured to the front wall of the cylinder block of the near bank of cylinders. One outlet communicates with an opening in the near cylinder block, while the other outlet communicates with an opening in the remote portion of the cylinder block via a pipe formed integrally with the cover. This eliminates any need for separate pipes between the coolant pump and the separate banks of cylinders. Accordingly, the length of the engine assembly in the axial direction of the crankshaft can be reduced, to miniaturize the entire engine. Since the coolant pipe is not located in a space between the two banks of cylinders, the engine can be mounted at the central portion of the two cylinder banks via brackets on a vehicle chassis, in a well-balanced state. In addition, the cover is formed integrally with a pipe which serves as a reinforcement rib to improve the rigidity of the cover, as well as to enable the compact formation of the cooling water pipe.

Having fully described our invention, it is to be understood that we are not to be limited to the details herein set forth but that our invention is of the full scope of the appended claims.

We claim:

1. In an internal combustion engine having a cylinder block with two banks of cylinders arranged in a V-shape and having a crankshaft supported in said block, the improvement comprising, in combination: a camshaft positioned above the crankshaft and mounted centrally on said block between the two banks of cylinders, timing gear means including driving and driven gears positioned only in front of the cylinder block for driving the camshaft in timed relation with the crankshaft, a coolant pump secured to the cylinder block laterally offset from the crankshaft and adjacent one bank of cylinders, a first discharge passage from said coolant pump to said bank of cylinders, means in front of said timing gear means for driving the coolant pump from said crankshaft, the front of said timing gear means facing a direction same as the front of said engine block, said pump driving means including driving and driven pulleys mounted on the crankshaft and the coolant pump, respectively, and a second discharge passage positioned between a plane formed by said driving and driven gears of the timing gear means and a second plane formed by said driving and driven pulleys of the said pump driving means, said second discharge passage extending from said coolant pump to the other bank of cylinders.

2. In an internal combustion engine having a cylinder block with two banks of cylinders arranged in a V-shape and having a crankshaft supported in said block, the improvement comprising, in combination: a camshaft positioned above the crankshaft and mounted centrally on said block between the two banks of cylinders, timing gear means positioned only in front of the cylinder block for driving the camshaft in timed relation with the crankshaft, a cover enclosing the timing gear means secured to the cylinder block, a coolant pump secured to the cylinder block laterally offset from the crankshaft and adjacent one bank of cylinders, a first discharge passage directly opening to the cylinder block and extending from said coolant pump to said bank of cylinders, means in front and outside of said cover for driving the coolant pump from said crankshaft, and means on said cover forming a second discharge passage from said coolant pump to the other bank of cylinders.

* * * * *